United States Patent [19]

Korsten et al.

[11] 3,950,602

[45] Apr. 13, 1976

[54] FURNACE INSTALLATION OPERATED BY DIRECT ELECTRICAL HEATING ACCORDING TO THE RESISTANCE PRINCIPLE IN PARTICULAR FOR PREPARATION OF SILICON CARBIDE

[75] Inventors: Andreas Korsten, Balkhausen; Theodor Benecke, Grefrath; Eugen Korndorfer, Heiligblut; Fritz Petersen, Grefrath; Gunter Wiebke, Munich, all of Germany

[73] Assignee: Elektroschmelzwerk Kempten GmbH, Munich, Germany

[22] Filed: Dec. 10, 1974

[21] Appl. No.: 531,236

[30] Foreign Application Priority Data

Dec. 21, 1973 Germany ..... 2364107

[52] U.S. Cl. ..... 13/20; 13/22

[51] Int. Cl.[2] ..... F27B 21/00

[58] Field of Search ..... 13/20, 22, 25, 23; 429/345, 441, 442, 174

[56] References Cited

UNITED STATES PATENTS

| | | | |
|---|---|---|---|
| 870,326 | 11/1907 | Tone | 13/20 |
| 3,647,384 | 3/1972 | Dessureault | 13/25 |
| 3,702,369 | 11/1972 | Bell | 13/25 X |

*Primary Examiner*—R. N. Envall, Jr.

*Attorney, Agent, or Firm*—Burgess Ryan and Wayne

[57] ABSTRACT

In a furnace installation for producing silicon carbide in an intermittent operation, carbon electrodes arranged in the bottom of the furnace. A horizontally arranged resistance core is electrically connected to the carbon electrodes by vertically extending elements of an electrically conductive material having a higher specific conductivity than the core material. The resistivity of the connection between the electrodes and the core and the current passing through the connection produces a temperature lower than that necessary to form silicon carbide, and thereby prevents the destruction of the connections and electrodes normally caused by the downward movement of the silicon carbide roller.

27 Claims, 7 Drawing Figures

Figure 1B:
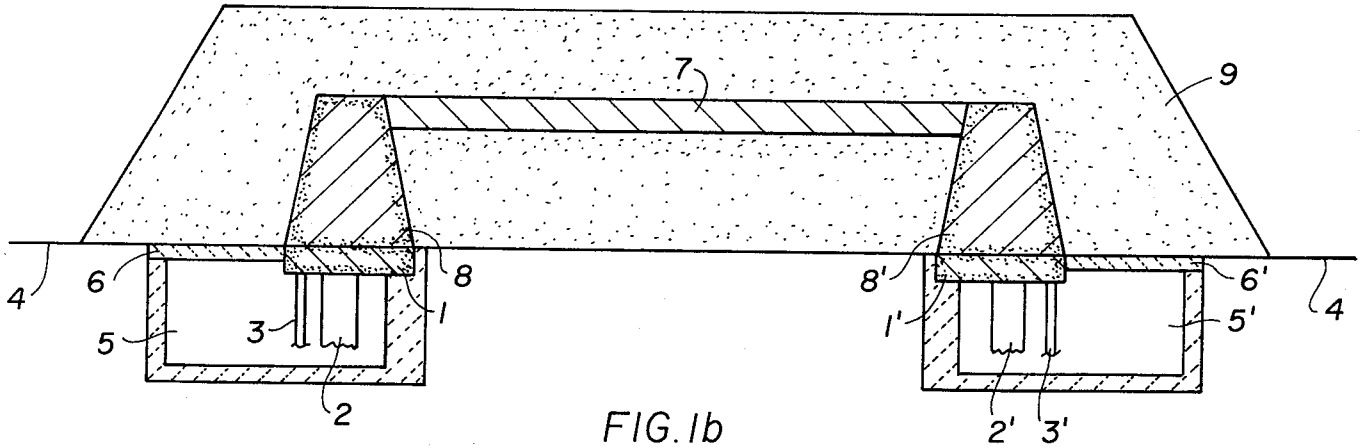

FURNACE INSTALLATION OPERATED BY DIRECT ELECTRICAL HEATING ACCORDING TO THE RESISTANCE PRINCIPLE IN PARTICULAR FOR PREPARATION OF SILICON CARBIDE

The present invention concerns improvements in and relating to electrical resistance furnaces. More particularly, the present invention relates to the type and arrangement of electrodes in the furnace. Other improvements in and relating to such furnaces are described and claimed in our pending U.S. application Ser. No. 531,621 filed Dec. 11, 1974 and Ser. No. 531,221 filed Dec. 10, 1974.

Carbides, and more particularly silicon carbide, are made on an industrial scale from a mixture of metal oxides and carbonaceous material. The basic reaction for the manufacture of silicon carbide is $$SiO_2 + 3C \rightarrow SiC + 2CO$$

The facts that silicon carbide sublimes, rather than melts, under normal pressure and that it dissociates at temperatures above 2500°C both dictate that this reaction be carried out by direct electrical heating according to the resistance principle in an electrical resistance furnace, rather than by heating in an arc furnace. (Although the present invention is described primarily with reference to the manufacture of silicon carbide, it is to be understood that the invention is not limited for furnaces for use in that manufacture, but that they can also be used for the manufacture of other substances, for example, electrographite).

According to the discontinuous process originally perfected by Acheson, industrial silicon carbide is prepared in electric resistance furnaces. The charge-like operation and the almost exclusive use of a resistance furnace instead of an electric arc furnace are determined by the nature of the silicon carbide and by the intended use. The properties of silicon carbide that dictate the resistance furnace are that it does not fuse at normal pressure and sublimates and dissociates above 2500°C.

Such resistance furnaces that can also be used in the same manner for the preparation of electrographite, for example, are in general rectangular, open on top and up to 20 m. long. The bottom and the fixed end walls are made of refractory bricks while the sidewalls are removable. The current is fed by the electrodes built in the end walls. The electrodes comprise an assembly of rectangular carbon or graphite rods that project from the end wall into the furnace. Copper laminae arranged between the carbon rods and connected to a common copper plate serve to connect the current. The ballast or load consists of a mixture of granulated coke and quartz sand and additional materials such as sawdust and common salt, in which the resistance core of granulated coke is horizontally inserted between the two end walls. The core also contains an inner shaft of extensively graphitized coke. To improve the passage of current, coke or graphite powder is introduced between the resistance core and the electrodes. By feeding current, within the temperature range of 1500° to 2500°C, a silicon carbide layer is formed about the coke core, which is generally designated as a silicon carbide "roll."

Since during the reaction the volume of the mixture decreases, there exists in furnaces of this construction the undesirable possibility that, when the current contact breaks down, electric arcs form in the interior of the furnace, resulting in local overheating and interference with the normal operation of the furnace. In addition, for economic reasons, furnaces having large dimensions are currently preferred. The use of large dimensioned furnaces, however, is associated with a high current load. Thus, the downward movement of the silicon carbide roll that often grows on the inner side of the furnace heads imposes extraordinarily great demands on the properties of the material, in particular, of the end walls and of the electrodes inserted therein. These demands can only be satisfied at great expense. Furnace heads of that kind are therefore exposed by thermal and mechanical stresses to an unusually great amount of wear and tear. Thus, they must be repaired after practically every furnace operation. These wear and tear phenomena become almost intolerable when they cause the interruption of the heating cycle.

Various gaseous by-products, known as "off-gases," and consisting primarily of carbon monoxide are produced in large amounts during the manufacture of the silicon carbide. These gases can be allowed to escape from the porous mixture into the atmosphere unhindered, but this entails the risk of carbon monoxide poisoning or of explosion. Alternatively, the gas can be ignited, but combustion is incomplete and the resulting smell is objectionable. Various proposals have been made for collecting these gases but some have resulted in severe explosions and have therefore not found acceptance. Degassing devices used in small closed furnaces and for continuous processes in small reaction chambers are not suitable for use in these large resistance furnaces.

The seriousness of this problem, especially with regard to pollution of the environment, can be appreciated when it is realised that, according to the above equation, for every ton of silicon carbide produced 1.4 tons (that is 1120 $m^3$) of carbon monoxide are formed. Various other gaseous by-products, such as hydrocarbons (especially methane) and hydrogen sulphide also form from the impurities in the coke. Only part of these gases can be burnt off at orifices in the side walls of the furnace or on the surface of the mixture: the rest escapes into the atmosphere.

Other disadvantages of the present furnaces result from the physical nature of the furnaces and from the physical operations involved in charging and emptying the furnaces. The furnaces are of two basic types: stationary and movable. For space economy reasons, the stationary furnaces are generally arranged close to one another in a furnace hall, where all the work involved in the operation of the furnaces is carried out. Because of the close spacing of the furnaces, the charging and emptying has to be carried out with costly crane devices. Much dust is produced during these operations, and heat currents within the hall also tend to stir up the dust.

Movable furnaces, which can be passed on conveyor belts or rails through fixed filling stations, stripping stands for pulling of the side walls, and spraying stations for rapidly cooling the silicon carbide rolls, are also used. Crane devices are of course dispensed with when using these furnaces, but the furnace construction and installation is necessarily complex and costly. Because the furnaces are also necessarily of restricted length and width, they must have high side walls. Emptying of the furnace is carried out by removing the side walls and pushing out the entire furnace mixture. Because the resulting dust production is so extensive that it cannot be controlled by spraying with water, this stripping of the furnace cannot be carried out in the open. This type of furnace is prone to faults as a result of vibrations during transport.

In both types of furnace, the side walls are exposed to very high wear caused both by heat and by mechanical stress, due to the pressure of the hot mixture. To withstand this wear it becomes necessary to use side walls made of iron frames filled with refractory material, but this involves the danger of the iron frame undergoing inductive heating as the growing silicon carbide roll shortens the distance between the current conductor and the frame; current flux can also occur via the wall elements. A further disadvantage is that the hot mixture tends to escape through gaps between the individual wall elements and through the orifices provided for venting.

According to the invention, these undesirable features are overcome by a novel arrangement of the electrodes in a resistance furnace that permits a simplification of the whole furnace installation and/or the use of less resistance electrode material.

The furnace installation operated by direct electrical heating according to the resistance principle that is the object of the invention serves for producing silicon carbide from silica and carbonaceous material in an intermittent operation. The current is directed by means of electrodes through a resistance core made of carbon that is horizontally inserted into the ballast of a mixture of granulated coke, quartz sand and added materials. According to the invention, the electrodes are disposed as bottom electrodes connected to the resistance core by electrically conductive material extending substantially vertically from the electrodes. The resistance core is preferably arranged so that its two ends abut against the two connection elements. In this way the resistance core forms a bridge, with each end abutting against a conductive "pillar," and each "pillar" standing on an electrode. This connection is not constructed as a component part of the resistance core, and has a higher electric conductivity than the latter.

In the furnace installation according to the invention, the bottom electrodes are disposed with their contact surfaces wholly or partly below or slightly above the bottom of the furnace. The furnace bottom is used as the supporting surface of the ballast and is advantageously on the same plane as the ground level. The electrodes are preferably mounted so that their contact surfaces are on the same plane as the ground level, or up to about 10 cm. therebelow, whereby mechanical damages when stripping the furnace are eliminated. The current is fed by electric circuits passing under the ground level.

The connection between the bottom electrodes and the resistance core is made by an electrically conductive material that is preferably a material having higher specific conductivity than the core material. The higher electric conductivity of the connection in comparison to the core can also be obtained, however, by enlarging the cross section of the connection in comparison to the cross section of the core. What is decisive here is only that the current heat appearing in the connection is less than that necessary for the formation of SiC. Thus, the latter is formed preferably about the core. This connection can consist either of a ballast of coke and/or graphite, and is preferably tamped coke and/or graphite mounted perpendicularly on the electrodes. Alternatively, a compacted material may be mounted on the electrodes. It is not necessary, however, to mount the compact material completely perpendicularly on the electrodes. Examples of compacted material that meets the specified conditions regarding the electric conductivity are ceramic materials with graphite inclusions, metals or metal alloys having a melting point above the reaction temperatures, or tamped masses of anthracite coal and graphite that have been reinforced with a binder such as coal tar pitch, and if necessary, carbonized.

The spacing between the resistance core and the bottom electrodes, and thus the minimum height of the connection in relation thereto are advantageously dimensioned so that the roll that grows during the heating cycle will not move down by the volume reduction of the load until making contact with the furnace bottom and/or the electrode contact surfaces. The roll is thus prevented from growing on the furnace bottom or the contact surfaces. The desired size of the roll depends on the size of the furnace and on the amount of power fed into the furnace.

The load needed for the reaction can be charged across the bottom electrodes and the resistance core according to its natural charge cone and the installation can be operated as a resistance furnace without walls, that is, without lateral and end boundaries, by means of wall elements. But the whole furnace installation can also be surrounded by walls in the conventional manner, said walls receiving the load but both for the lateral delimitation and also for closing the front-end, simple, transportable walls can be used.

The open ballast of course is not financially advantageous when operated indoors due to the large area it occupies, and thus, such furnaces are best operated as stationary outdoor installations.

Graphite or other carbon electrodes equipped with current and cooling water connections may be used as bottom electrodes. These electrodes are commonly used in furnace installations with so-called front electrodes.

It is preferable, however, to use as bottom electrodes, tamped mass electrodes of coke and/or graphite equipped with current and cooling water connections. If desired, metal conductors, preferably of copper, can be embedded in the tamped mass electrodes. In said tamping mass electrodes cooling coils made of metal, preferably copper, can also be embedded. If desired, a power supply and cooling system can be combined in the form of cooled metal pipes, preferably streamlined copper pipes. The tamping composition is preferably a mixture of a carbon, such as anthracite coal, graphite and binders, such as coal tar pitch. Prior to starting the operation of the electrode the composition is carbonized in an annealing furnace by heating it to about 600°C for mechanical reinforcement and to increase the conductivity thereof.

A preferred form of bottom electrode may be equipped with current and cooling water connections, and is made of metal, preferably copper, it being possible if desired to introduce cooling coils made of metal.

The use of electrodes of tamping compositions or of metal of the kind indicated is permitted by their arrangement as bottom electrodes according to the invention, since due to the enlarged spacing between the electrodes and the real heating zone, the temperatures that appear on the electrodes are considerably lower than in the known furnace installations with electrodes built in at the front. The fact that the connection has greater conductivity than the real core is of decisive importance. The bottom electrodes are preferably cooled by water cooling.

Figure 1A:
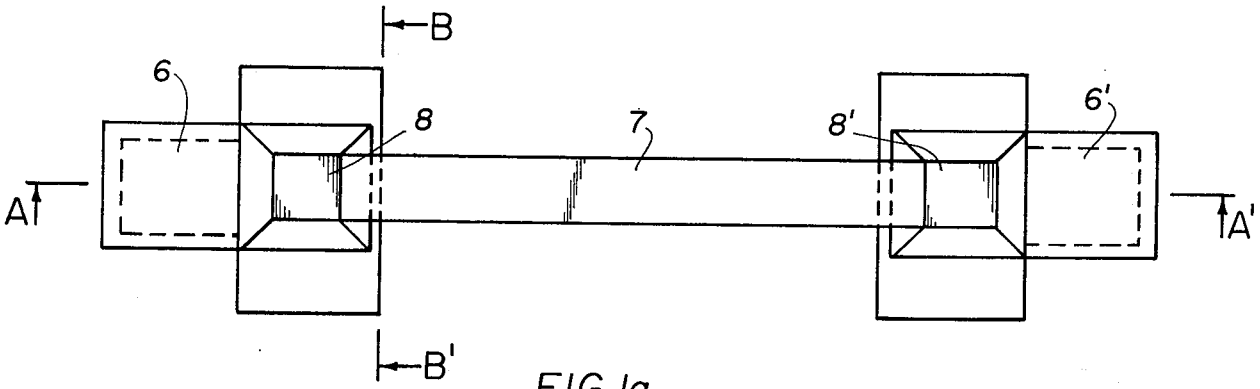
Figure 1C:
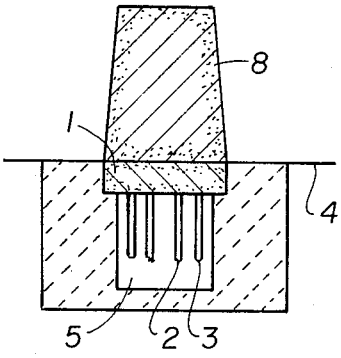
Figure 2:
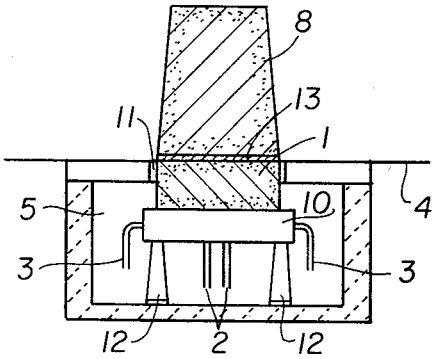
Figure 3A:
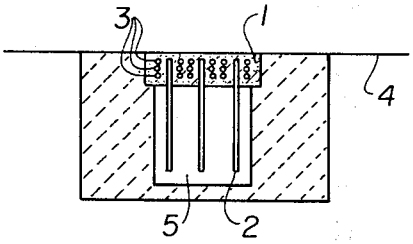
Figure 3B:
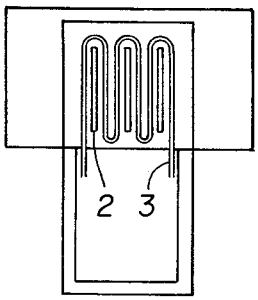

The invention will now be described in greater detail, with reference to the accompanying drawings, wherein:

FIG. 1*a* shows an outline of the installation seen from the top;

FIG. 1*b* shows the installation in cross section along the line A–A′ in 1(*a*);

FIG. 1*c* shows the installation in cross section along the line B–B′ in 1(*a*);

FIG. 2 shows the arrangement of a graphite or other carbon electrode as bottom electrode in cross section;

FIG. 3*a* shows the arrangement of a cooled tamped mass electrode as a bottom electrode, the view being in cross section;

FIG. 3*b* shows the same arrangement seen from above; and

Figure 4:
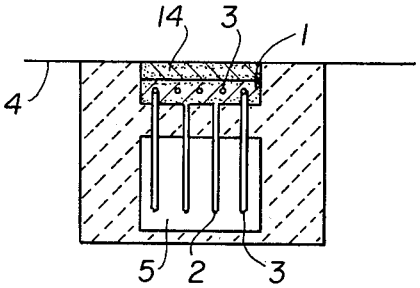

FIG. 4 shows in cross section the arrangement of a cooled electrode of copper as bottom electrode.

As it can be seen from FIG. 1*b*, the bottom electrodes 1 and 1′ with the current connections 2,2′ and cooling connections 3,3′ are disposed at a distance corresponding to the length of the furnace. The bottom electrodes with the connections are laid beneath the ground, that is, below ground level 4, and are housed in the assembly chamber 5 and 5′ that is surrounded by a concrete enclosure. The assembly chamber is accessible by entrances covered by bottom plates 6 and 6′. The connection between the bottom electrodes 1 and 1′ and the horizontally disposed resistance core 7 is made by the vertically mounted ballast 8 and 8′ of rammed coke and/or graphite that has the shape of a conic section. Thereupon is arranged the load 9 that has been distributed according to its natural cone.

In FIG. 1*c* can be seen the arrangement of the ballast 8 having the shape of a conic section and being vertically mounted on the bottom electrode 1. In addition, FIG. 1*c* shows the assembly chamber 5 arranged below ground level 4, from which are accessible the electrodes 1 the current connection 2 and the cooling connection 3.

In the arrangement illustrated in FIG. 1*c*, it is apparent that, since the ballast 8 is in the shape of a conic section (i.e., pyramidal), the two ballast members have faces directed toward each other which are inclined. The two ends of the core 7 abut the inclined faces of the ballast members 8 and 8′. With this arrangement, good electrical contact is maintained between the ballast members and the core, even if the core moves downwardly.

In the top view according to FIG. 1*a*, the parts of the installation disposed below ground level cannot be seen; this Figure identifies the section lines for the cross sections according to FIGS. 1*b* and 1*c*.

In the following FIGS. 2 to 4, the electrode arrangements that according to the invention can be used as bottom electrodes are explained in more detail.

In FIG. 2, the electrode of graphite or other carbon 1 is disposed under the ground level 4 and connected to the current vanes 2 and the cooling connections 3 for supplying water to the cooling pockets 10. Between the electrode 1 and the concrete enclosure of the assembly chamber 5 is situated an expansion joint 11 sealed with carbon felt or asbestos wool. The electrode 1 is fixed on the bottom of the assembly chamber by means of supporting devices 12. On the surface of electrode 1 is tamped a layer 13, preferably of pure graphite, that serves to improve the contact with the vertically mounted ballast 8 that has the shape of a conic section.

In FIGS. 3*a* and 3*b*, the electrode made of a tamped mass 1 is disposed below ground level 4 in the assembly chamber 5 in which are embedded the conductors 2 made of streamlined copper strips and the cooling pipes 3. In FIG. 3*b* can be seen the registers of copper pipes 3 used for cooling.

In FIG. 4, an electrode made of copper plate 1, streamlined at the contact surface is disposed below the ground level 4 in the assembly chamber 5. By 2 are designated the current vanes and by 3 the cooling system. On the streamlined copper plate 1 is mounted a protective layer 14 made of a tamped mass.

In all electrodes having the construction that appears in the Figures, the presence of the assembly chamber 5 is not indispensably required; that is, the chamber can be eliminated by laterally arranging the current connections, and if needed, the cooling connections.

The furnace installations according to the invention offer in comparison to the conventional furnace installations having built-in electrodes at the front the following advantages:

The construction of the hitherto necessary furnace heads of refractory material for receiving the front electrodes is not needed. By the arrangement of the electrodes in the manner described they are no longer exposed directly to the high temperatures in the reaction zone, which guarantees their preservation for a longer time, and in addition the design of the cooling system is less expensive. The weight of the load lying thereon firmly presses the connection 8 against the electrodes and the resistance core against the connection 8. Thus, an excellent contact is ensured. This contact is maintained when the silicon carbide roll that forms moves down due to the reduction in volume of the load. This means that there is no arcing, with consequent overheating and electrode wear, as occurs with end-face electrodes because of poor electrical contact as the silicon carbide roll tears away from the electrodes during the course of the reaction.

In addition, the silicon carbide roll has an unhindered freedom of movement when it moves down due to the reduction of volume of the load during the heating cycle since it can no longer grow on the furnace heads. The downward movement of the roll and of the burden material thereunder therefore takes place more uniformly whereby the formations of bridges and cavities are avoided, and thus the furnaces of that kind are operated practically without so-called "blowers". The removal of the silicon carbide roll in addition is no longer complicated by such operations. On the contrary, the roll is accessible easily from all sides so that the load can be removed without expensive crane apparatus and using simple vehicles. Mechanical damages of the furnace installation no longer appear since in the arrangement according to the invention all conductors together with the connections are laid underground, resulting in a greater reliability in the operation.

Furthermore, the usefulness of the arrangement according to the invention of the electrodes as bottom electrodes in furnace installations operated by direct electric heating according to the resistance principle must be said to be unobvious, for according to the coinciding opinion of technicians, the desired power supply could not be maintained by such an arrangement inasmuch as according to experience, the current flows across the shortest path, that is, in this case, below the core, directly through the burden.

What is claimed:

1. Furnace installation of the type operated by direct electric heating according to the resistance principle, for the preparation of silicon carbide from silica and carbonaceous material in intermittent operation, the current being supplied by means of electrodes through a resistance core of carbon horizontally inserted in a load consisting of a mixture of granulated coke, quartz sand and added materials, the improvement wherein the electrodes are arranged below the load as bottom electrodes and wherein a substantially vertical electric conducting means is arranged on top of each electrode connecting the electrodes to the resistance core, said connection being constructed separately of the resistance core and having a higher electric conductivity than the latter.

2. Furnace installation according to claim 1, wherein the upper contact surfaces of the bottom electrodes are level with the furnace floor.

3. Furnace installation according to claim 1, wherein the conducting means is of a material having a higher specific conductivity than the core.

4. Furnace installation according to claim 1, wherein the conducting means has a greater cross-section than the core.

5. Furnace installation according to claim 1, wherein the upper contact surfaces of the bottom electrodes are up to 10 cm below the bottom of the furnace.

6. Furnace installation according to claim 1, wherein the conducting means comprises a ballast of coke and graphite vertically mounted on the electrodes.

7. Furnace installation according to claim 6, wherein the ballast comprises tamped coke and graphite.

8. Furnace installation according to claim 1, wherein the conducting means comprises a ballast of graphite vertically mounted on the electrodes.

9. Furnace installation according to claim 8, wherein the ballast comprises tamped graphite.

10. Furnace installation according to claim 1, wherein the conducting means comprises a ballast of anthracite coal, graphite, and a binder vertically mounted on the electrodes.

11. Furnace installation according to claim 10 wherein ballast is tamped.

12. Furnace installation according to claim 1, wherein the conducting means comprises a compact material mounted on the electrodes.

13. Furnace installation according to claim 1, wherein the load is distributed over the bottom electrodes and the resistance core according to its natural cone and the installation is operated as a resistance furnace without walls.

14. Furnace installation according to claim 1, wherein the installation is equipped with walls.

15. Furnace installation according to claim 1, wherein graphite electrodes equipped with electrical current and cold water connections are used as said bottom electrodes.

16. Furnace installation according to claim 1, wherein carbon electrodes equipped with electrical current and cold water connections are used as said bottom electrodes.

17. Furnace installation according to claim 1, wherein tamped mass electrodes of graphite equipped with current and cold water connections are used as said bottom electrodes.

18. Furnace installation according to claim 1, wherein tamped mass electrodes of coke graphite and a binder equipped with current and cold water connections are used as said bottom electrodes.

19. Furnace installation according to claim 18 wherein said tamped mass is formed by carbonizing in an annealing furnace by heating to about 600°C.

20. Furnace installation according to claim 17, wherein metal conductors are embedded in the tamped mass electrodes.

21. Furnace installation according to claim 17, wherein metal cooling coils are embedded in the tamped mass electrodes.

22. Furnace installation according to claim 17, wherein current supply and cooling system in the form of cooled metal pipes are combined in the tamped mass electrodes.

23. Furnace installation according to claim 22, wherein the cooled metal pipes are made of streamlined copper tubes.

24. Furnace installation according to claim 1, wherein metal electrodes equipped with current and cold water connections are used as said bottom electrodes.

25. Furnace installation according to claim 24, wherein the electrodes are made of copper.

26. Furnace installation according to claim 18, wherein metal cooling coils are embedded in the electrodes.

27. A resistance heating furnace, comprising a furnace bottom, a pair of bottom electrodes, in said furnace bottom extending no higher than said furnace bottom, an electrically conductive connecting means extending substantially vertically from each of said electrodes, and a resistance core extending between said conductive connecting means above said furnace bottom, said connecting means having a higher conductivity than said core, and having inclined faces directed toward each other, said resistance core being positioned with its ends abutting said inclined faces.

* * * * *